United States Patent [19]

Delwel et al.

[11] 4,434,068

[45] Feb. 28, 1984

[54] PROCESS FOR MANUFACTURING DETERGENT SPECKLES

[75] Inventors: Francois Delwel, Dordrecht; Roland De Goede, Vlaardingen, both of Netherlands

[73] Assignee: Lever Brothers Company, New York, N.Y.

[21] Appl. No.: 355,790

[22] Filed: Mar. 8, 1982

[30] Foreign Application Priority Data

Mar. 18, 1981 [GB] United Kingdom ..... 8108463

[51] Int. Cl.[3] ..... C11D 3/06; C11D 11/02

[52] U.S. Cl. ..... 252/135; 252/89.1; 252/174; 252/174.13; 252/174.18

[58] Field of Search ..... 252/89.1, 135, 174, 252/174.13, 174.18

[56] References Cited

U.S. PATENT DOCUMENTS

| | | | |
|---|---|---|---|
| 2,889,283 | 6/1959 | Tecklenburg | 252/89.1 |
| 4,097,418 | 6/1978 | Rolfes | 252/174.13 |
| 4,207,197 | 6/1980 | Davis et al. | 252/99 |

*Primary Examiner*—John E. Kittle
*Assistant Examiner*—Robert A. Wax

[57] ABSTRACT

Colored speckles, for imparting a speckled appearance to uncolored powder, or for varying that of already colored powder are manufactured by a process involving spraying onto particulate material such as spray dried detergent base powder. Evenly colored, visually distinctive non-segregating speckles are obtained.

5 Claims, No Drawings

PROCESS FOR MANUFACTURING DETERGENT SPECKLES

This invention relates to coloured speckles for use in detergent compositions and to a process for manufacturing them.

The manufacture of coloured speckles is a continuing problem to the detergents industry, for it is not easy to find a process which produces satisfactory speckles and yet which is not disruptive to operate in a detergent plant. Satisfactory speckles must be uniformly coloured, of narrow particle size distribution and of a bulk density similar to that of the powder in which they are to be incorporated. Speckles with one or more of these features missing will be unsatisfactory as either they will be insufficiently distinctive visually, or they will segregate from the powder and, for instance, disappear beneath its surface altogether.

One method of producing speckles which do not segregate is to spray-dry a coloured crutcher slurry, but that is extremely disruptive, as after spraying the spray-drying tower must be thoroughly cleansed before colourless powder can be produced again. Another method is to spray a coloured solution onto spray-dried powder. However, if colours of a sufficiently deep hue are to be produced it is necessary to spray such a large amount of coloured solution onto the material that it must be subjected to an additional drying step.

We have now discovered how to produce speckles by a spraying process having the required depth of colour without the necessity for a drying step.

According to the present invention there is provided a process for the production of coloured speckles for use in detergent powders which comprises spraying particulate material with an aqueous solution of colourant characterised in that the solution also comprises a hydratable salt.

It is preferred that the aqueous solution of the colourant is at an elevated temperature when it is sprayed so that crystallisation of the hydratable salt is aided by the cooling which will inevitably take place.

The process can conveniently be carried out in a Schugi Flexomix (registered trade mark) mixer, which is a cylindrical mixer fitted with a set of variably inclined blades rotatable about its major axis. Spray nozzles can be incorporated into the side-wall of the cylinder for the introduction of liquids. However, the process can equally well be carried out in other apparatus such as rotating-drum mixers, fluidised beds, spiral mixers or pan-granulators of the "Eirich" (registered trade mark) type.

The chemical composition of the speckles themselves is not an important feature of the invention, speckles formed from single compounds such as sodium tripolyphosphate or from simple or complex mixtures being equally susceptible to the process. However, because of the size distribution and bulk density considerations it is preferred that the speckles are formed from spray-dried particles comprising detergent-active substances, builders and other conventional components of detergent compositions that is to say, from spray-dried detergent base powder.

The hydratable salt may be any hydratable salt which is suitable for use in detergent compositions. In general it is preferred that salts crystallising with a large amount of water of crystallisation should be used. Examples of those are phosphates, carbonates especially sodium carbonates, and sulphates especially sodium sulphate. The hydratable salts will generally be present in the solution in amounts of from 15 to 60% by weight. It is preferred that the solution is close to saturation at elevated temperature and most preferred that it is supersaturated, so that crystallisation is aided both by the cooling and by the up-take of water into the solid which takes place when the solution is sprayed onto particulate material.

It is desirable that the solution should also contain a small amount of a binder, for example sodium silicate or sodium carboxymethyl cellulose. Typically the amount of the binder should be from 1 to 15% by weight of the solution.

Whereas in a conventional process for making speckles by spraying a colourant solution onto suitably sized material the highest liquid to solids ratio which can be used without the necessity for an additional drying step is about 0.07, in the process of the invention ratios of up to 0.2, or even more in some cases, can be used.

If a coloured solution is merely sprayed onto spray-dried detergent powder, the resultant speckles are of wide particle size distribution, and the high proportion of fines results in an overall pale hue being imparted to a colourless powder. In contrast, where the process is carried out in an apparatus which produces agglomeration or granulation, then the particle size of spray-dried powder will be increased and the particle size distribution will be narrowed, resulting in a more distinctive and uniform speckle.

The invention is further described and illustrated in the following example.

EXAMPLE 1

A conventional crutcher slurry for manufacturing a low-sudsing fabric washing powder containing a ternary mix of anionic surfactant, nonionic surfactant and soap, with a sodium tripolyphosphate detergency builder was spray-dried in a counter-current spray-drying tower in a known manner.

The spray-dried powder obtained was then divided into two batches. Each batch was fed to a Schugi Flexomix (registered trade mark) mixer operating at a rotational frequency of 26.5 Hz with the mixing blades fixed at an angle of +8°.

The first batch of spray-dried powder was sprayed through two twin phase nozzles with a control solution containing 12 parts of a blue dyestuff per 100 parts of water in amounts varying from 7 to 15% by weight based on the weight of the powder. It was found that satisfactory speckles were produced by this process at the higher liquid-solid ratios but that when the level of dyestuff solution rose to 10% or more, it was necessary to dry them in a fluidised bed dryer.

The second batch of powder was sprayed with a similar solution X under similar conditions except that the solution contained hydratable salts in accordance with the invention. The formulation used is shown below.

| | % by weight Solution X |
|---|---|
| Disodium orthophosphate | 34.2 |
| Sodium metasilicate | 2.1 |
| Sodium tripolyphosphate | 6.4 |
| Monastral Blue | 0.8 |

-continued

| | % by weight Solution X |
|---|---|
| Water | 56.5 |

EXAMPLE 2

A similar experiment to that described in Example 1 was performed with Solution Y which was of the formulation shown below.

| | % by weight |
|---|---|
| Disodium orthophosphate | 24.0 |
| Sodium metasilicate | 11.1 |
| Sodium tripolyphosphate | 1.8 |
| Monastral Blue | 1.0 |
| Water | 62.1 |

It was found possible to spray as much as 21%, on a weight/weight basis, of Solutions X and Y onto the spray-dried material without the need for drying the speckles. Furthermore, these speckles were entirely satisfactory from the view of colour intensity and colour distribution and exhibited a noticeable size increase and improved size distribution over the original unsprayed material, increasing their visibility when incorporated into uncoloured detergent powder.

What we claim is:

1. A process for the production of coloured speckles for use in detergent powders which comprises spraying particulate material with an aqueous solution of colourant characterised in that the solution also comprises a hydratable salt, and the particulate material onto which the solution is sprayed comprises a spray-dried detergent base powder.

2. A process according to claim 1 characterised in that the content of hydratable salt in the solution to be sprayed is from 15 to 60% by weight.

3. A process according to claim 1 characterised in that the solution to be sprayed comprises a binder.

4. A process according to claim 1 characterised in that the ratio of the weight of solution to be sprayed to the weight of particulate material is from 0.07 to 0.2.

5. A process according to claim 1 characterised in that the hydratable salt comprises disodium orthophosphate or sodium tripolyphosphate.

* * * * *